US008657243B2

(12) United States Patent
Marugg

(10) Patent No.: US 8,657,243 B2
(45) Date of Patent: Feb. 25, 2014

(54) OPERATING TABLE

(76) Inventor: Silvio Marugg, Stetten (CH)

( * ) Notice: Subject to any disclaimer, the term of this patent is extended or adjusted under 35 U.S.C. 154(b) by 69 days.

(21) Appl. No.: 13/294,982

(22) Filed: Nov. 11, 2011

(65) Prior Publication Data

US 2012/0205509 A1 Aug. 16, 2012

(30) Foreign Application Priority Data

Nov. 11, 2010 (DE) ..... 10 2010 051 126

(51) Int. Cl.
*A47B 91/00* (2006.01)

(52) U.S. Cl.
USPC ..... 248/188.8; 5/620; 248/346.05

(58) Field of Classification Search
USPC ..... 248/688, 188.1, 188.6, 188.8, 346.05; 5/600, 620, 510
See application file for complete search history.

(56) References Cited

U.S. PATENT DOCUMENTS

| | | | | | |
|---|---|---|---|---|---|
| 721,610 | A | * | 2/1903 | Scott | 5/510 |
| 2,553,939 | A | * | 5/1951 | Pivovaroff | 280/35 |
| 4,064,591 | A | * | 12/1977 | Hutchison | 16/99 |
| 4,186,917 | A | | 2/1980 | Rais et al. | |
| 4,225,125 | A | | 9/1980 | Lee | |
| 4,869,266 | A | | 9/1989 | Taylor et al. | |
| 5,347,682 | A | * | 9/1994 | Edgerton, Jr. | 16/34 |
| 5,564,662 | A | | 10/1996 | Lussi et al. | |
| 5,806,111 | A | * | 9/1998 | Heimbrock et al. | 5/86.1 |
| 5,987,671 | A | * | 11/1999 | Heimbrock et al. | 5/600 |
| 6,286,165 | B1 | * | 9/2001 | Heimbrock et al. | 5/600 |
| 6,298,506 | B1 | | 10/2001 | Heinold et al. | |
| 6,401,278 | B1 | * | 6/2002 | Hayes et al. | 5/600 |
| 6,460,205 | B1 | * | 10/2002 | Lewandowski et al. | 5/600 |
| 6,792,630 | B1 | * | 9/2004 | Palmatier et al. | 5/86.1 |
| 7,003,828 | B2 | * | 2/2006 | Roussy | 5/611 |
| 7,472,439 | B2 | | 1/2009 | Lemire et al. | |
| 7,886,377 | B2 | * | 2/2011 | Hamberg et al. | 5/86.1 |
| 7,896,118 | B2 | * | 3/2011 | Williamson et al. | 180/209 |
| 8,381,330 | B2 | * | 2/2013 | Roussy et al. | 5/86.1 |
| 2001/0018016 | A1 | | 8/2001 | English, Jr. et al. | |
| 2006/0277683 | A1 | | 12/2006 | Lamire et al. | |
| 2007/0271700 | A1 | * | 11/2007 | Reinke et al. | 5/600 |
| 2011/0126354 | A1 | * | 6/2011 | Hamberg et al. | 5/600 |
| 2012/0198620 | A1 | * | 8/2012 | Hornbach et al. | 5/510 |

FOREIGN PATENT DOCUMENTS

| | | | |
|---|---|---|---|
| DE | 1 054 663 | B | 4/1959 |
| DE | 28 18 362 | A1 | 11/1978 |
| DE | 27 38 107 | A1 | 12/1978 |
| DE | 196 12 091 | A1 | 3/1997 |
| DE | 199 15 852 | C2 | 12/2003 |
| DE | 10 2004 040 721 | A4 | 12/2005 |
| DE | 10 2005 050 856 | B4 | 11/2009 |
| DE | 10 2010 020 129 | A1 | 11/2011 |
| EP | 0 366 365 | A2 | 5/1990 |

(Continued)

OTHER PUBLICATIONS

German Search Report dated Nov. 22, 2011 in corresponding German Patent Application No. 10 2010 051 126.9, 5 pages.

(Continued)

*Primary Examiner* — Bradley Duckworth

(57) ABSTRACT

An operating table has a movable base which is provided with four casters, wherein the casters are each pivotable via a pivot lever. The pivot levers are connected to one another by a common drive and a linkage.

13 Claims, 2 Drawing Sheets

(56) References Cited

FOREIGN PATENT DOCUMENTS

| | | | |
|---|---|---|---|
| EP | 0 450 836 | B1 | 11/1994 |
| EP | 0 536 922 | B1 | 11/1995 |
| EP | 1 634 558 | A1 | 3/2006 |
| EP | 1 635 153 | A2 | 3/2006 |
| EP | 2 020 217 | A1 | 2/2009 |
| GB | 728093 | A | 4/1955 |
| WO | 99/25303 | A1 | 5/1999 |
| WO | 2006089399 | A2 | 8/2006 |

OTHER PUBLICATIONS

English translation of German Search Report dated Nov. 22, 2011 in corresponding German Patent Application No. 10 2010 051 126.9, 6 pages.

* cited by examiner

OPERATING TABLE

CROSS-REFERENCE TO RELATED APPLICATIONS

This application claims the priority benefit of German patent application number 102010051126.9, filed Nov. 11, 2010, the entirety of which is incorporated by reference herein.

BACKGROUND OF THE INVENTION

1. Field of the Invention

The present invention relates to an operating table having a movable base. Such operating tables are known in the most varied embodiments. In order to ensure the stability of the operating table in this respect, the base should stand on four support points since with only three support points a stability would not be ensured even if the table would not wobble in this case. With a support at four points, the table can wobble if the floor or floor surface is not completely level.

2. The Prior Art

It is also known in this connection to provide a compensation of the unevenness of the floor, for example by hydraulic parking cylinders. Solutions of this type are, however, relatively complex and/or expensive and a tilt of the table surface can nevertheless occur under certain circumstances depending on the weight of the patient.

BRIEF DESCRIPTION OF THE INVENTION

It is the object of the present invention to provide an operating table having a movable base which allows a wobble-free positioning using simple means.

This object is satisfied by the features of claim 1 and in particular in that the base is provided with four casters which are each pivotable via a pivot lever provided at the base from a moving position into a standing position. In the moving position, each caster forms the lowest point of the operating table so that it can be rolled over the floor when all four casters are in their moving positions. In the standing position, the caster is raised relative to the base so that the base itself contacts the floor. The transition from the moving position into the standing position is effected in accordance with the invention by a pivot lever which can in particular be pivoted about a horizontal axis. In this respect, the caster can be directly fastened to the pivot lever or it can be actuated indirectly by the pivot lever, for example within a vertical guide or the like.

In accordance with the invention, in at least one caster pair, i.e. in two oppositely disposed casters, the associated pivot levers are connected to one another by a linkage and a common drive. In other words, only the linkage and the drive are located between the two pivot levers and both the drive and the linkage are movable between the pivot axes of the two pivot levers decoupled from the base. In this connection, it is admittedly a possible embodiment variant that the drive and/or the linkage are supported in a slide guide or the like at the base. However, in accordance with the invention, such a guide or support must ensure that a free movement of the linkage and of the drive is possible, and indeed in particular along an imaginary connection line between the two connection points of the drive and of the linkage at the associated pivot levers.

Two mutually opposite casters can be raised or lowered freely and independently of one another using the construction in accordance with the invention, which can have a very simple mechanical design, since the elements connecting the two pivot levers are freely movable in the longitudinal direction and are not fixed at the base. It is possible in this manner first to lower the base completely onto the floor by raising all casters and subsequently to actuate the drive for so long until the operating table stands on the ground in a wobble-free manner. If the two casters which are connected to one another via the drive and the linkage stand on an uneven surface, one of the two casters will have contact with the floor due to the weight of the operating table, whereas the other caster will not contact the floor or will contact it with insufficient contact force. This caster can be lowered independently of the caster connected to it via the linkage by actuating the drive so that the unevenness of the floor can be compensated.

In accordance with a further aspect of the invention, it includes a method for positioning an operating table of the above-described kind in which the casters of the base are initially pivoted at a desired location of the operating table from their moving position into an end position in which the base is completely lowered onto the floor; the drive is subsequently, if necessary, actuated for so long until four measuring devices for determining the contact force at supports of the base output a substantially coinciding measured value. It is not absolutely necessary in this respect, due to tolerances, that the output measured value exactly coincides. As a result, the coincidence only has to be so great that the operating table does not wobble.

Advantageous embodiments of the invention are described in the description, in the drawing and in the dependent claims.

In a first advantageous embodiment, the drive can have an electric motor, in particular a single electric motor, and can in particular be provided with a self-locking transmission. In addition to pneumatic or hydraulic linear cylinders, which can likewise be provided as a drive, the raising and lowering of the casters in this embodiment can be controlled particularly precisely, with no locking or braking device having to be provided in the case of a self-locking transmission to ensure the freedom from wobble of the operating table. The use of an electric motor furthermore allows the measuring of the motor current, with a conclusion also being able to be drawn from the motor current on the pressure with which the casters lie on the floor.

In accordance with a further advantageous embodiment, the drive causes a linear movement and both the drive and the linkage are freely movable relative to the base in the direction of movement of the drive, i.e. in the direction of the linear movement. In this embodiment, the linear movement can be generated, for example, by a spindle which is driven by a motor and which moves in linear fashion within a guide. Alternatively, linear drives such as linear motors, pneumatic cylinders, hydraulic cylinders or also other drives are possible.

In accordance with a further advantageous embodiment, the pivot lever includes a hinge plate which is pivotally connected to the base and at which a caster is fastened. Such a hinge plate can be fastened to the base at a horizontal pivot axle and can, for example, be formed as a two-armed lever, with the caster being fastened to one arm of the lever and the linkage or the drive being pivotally connected to the other arm of the lever. The functions in accordance with the invention can be realized in a particularly simple construction manner by a hinge plate designed in this manner. Alternatively, the caster and the pivot point for the linkage or for the drive can lie on one and the same side relative to the pivot axis of the hinge plate.

In accordance with a further advantageous embodiment, the casters of the other caster pair can also be connected to one another via a further common drive and via a further linkage, with the further drive and the further linkage being movable between the pivot axes of the two pivot levers decoupled from the base. In this embodiment variant, two respective casters are connected to one another via the drive and the linkage and the casters can be pivoted independently of one another so that an even better adaptation to an uneven surface is possible.

Provided the casters are designed as swivel casters, the operating table can be maneuvered particularly easily.

In accordance with a further advantageous embodiment, a measuring device can be provided for determining the contact pressure or the contact force between the casters of the caster pair and the floor. The operating table can be set up free of wobble in an automated manner by such a measuring device in that it is determined whether the measured contact pressure corresponds to a desired value. In this respect, the measuring device can be designed so that it detects the power consumption of the electric motor. The electric motor can then be activated for so long by setting a static or dynamic limit value until the measured value output by the measuring device corresponds to the limit value.

In accordance with a further advantageous embodiment, the base has four defined supports, with a measuring device for determining the contact force being provided at all supports. The measured results can be evaluated using suitable electronics and in the event of a risk of tilting, a corresponding warning can be output in good time or certain drives of the operating table can be deactivated. In addition, it is possible to use the measuring devices simultaneously for determining the patent weight. Since the measuring devices in this embodiment are provided beneath the base, not only the weight of the patient can be determined, but rather simultaneously a possible tilting can also be detected or a wobbling of the operating table can be eliminated in that the drive is actuated.

In a method in accordance with the invention for positioning an operating table which is provided with corresponding measuring devices, the casters of the base are pivoted at a desired location of the operating table from their moving position into an end position in which the base is completely lowered onto the floor. Subsequently—where necessary—the drive is actuated for so long until all four measuring devices output a substantially coinciding measured value since the operating table then lies on all four support points with the same force and a wobbling is precluded.

BRIEF DESCRIPTION OF THE DRAWINGS

The present invention will be described in the following purely by way of example with reference to an advantageous embodiment and to the enclosed drawings. There are shown.

DETAILED DESCRIPTION

Figure 1:
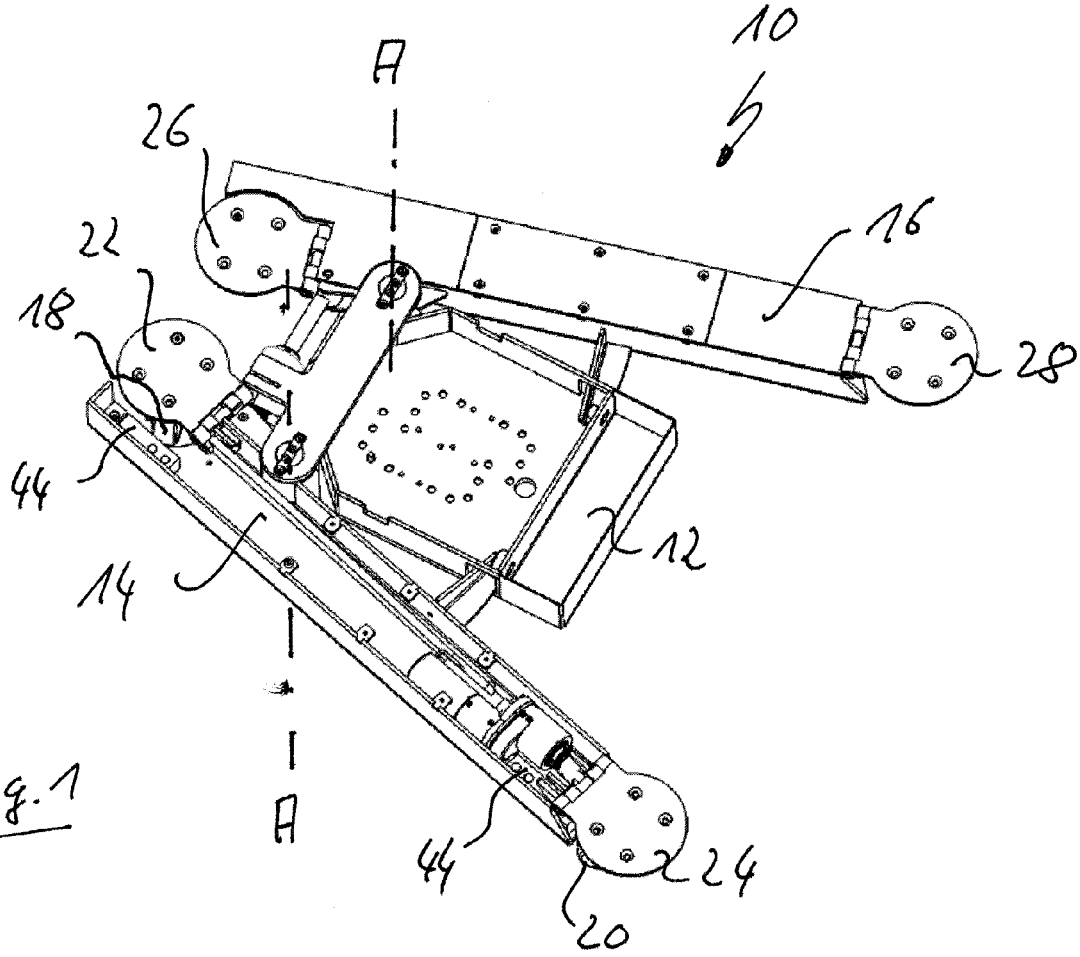
FIG. 1 is a perspective view of a base from above.
Figure 3A:
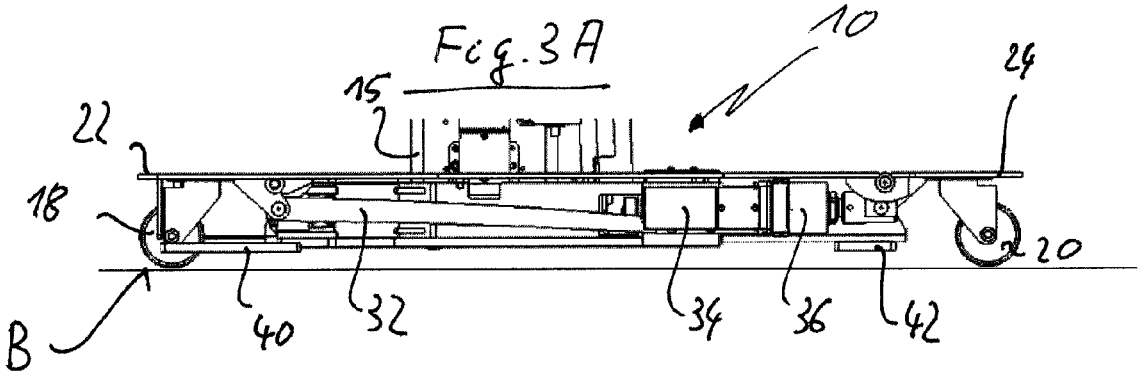
FIGS. 3A-3C are side views of the base in different positions during positioning.
Figure 3B:
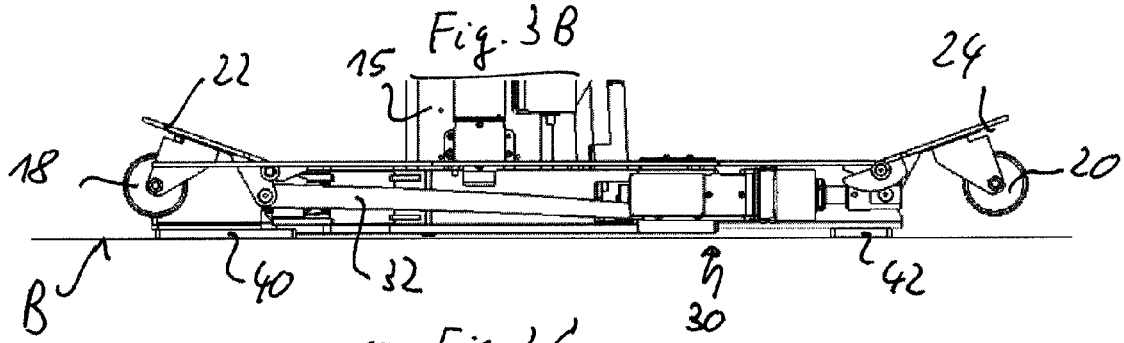
Figure 3C:
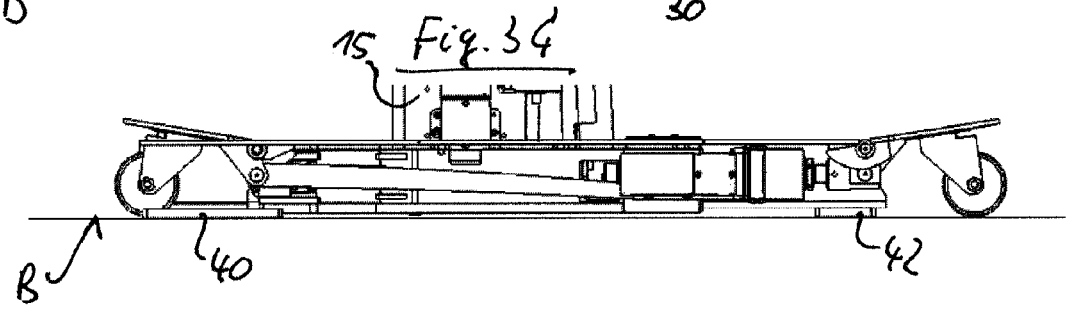

FIG. 1 shows a movable base 10 of an operating table which includes in a known manner a patient support (not shown) which is fastened to the base 10 via a column 15 (FIG. 3). The base 10 in the shown embodiment includes a central receiver 12 at which two base arms 14 and 16 are fastened pivotable about vertical axes A. The two base arms 14 and 16 are formed as hollow frame members, with a respective caster 18, 20 designed as a swivel caster being arranged at the two ends of each base arm 14 and 16. The casters of the base arm 16 cannot be recognized in the Figures.

As the Figures illustrate, each caster 18, 20 is fastened to the end of the base arms 14 and 16 via a hinge plate or pivot plate 22, 24, 26 and 28 which forms a pivot lever which is respectively pivotable about a horizontal axis B (FIG. 2) relative to the base 10. Each caster can in this respect be pivoted via its hinge plate from a moving position (FIG. 3A) in which a movement of the operating table is possible into a standing position (FIG. 3B) in which the casters no longer raise the operating table from the floor. The pivoting of the casters 18 and 20 relative to the base 10 takes place with the aid of a common drive 30 and of a linkage 32 which connect the two hinge plates 22 and 24 to one another.

Figure 4:
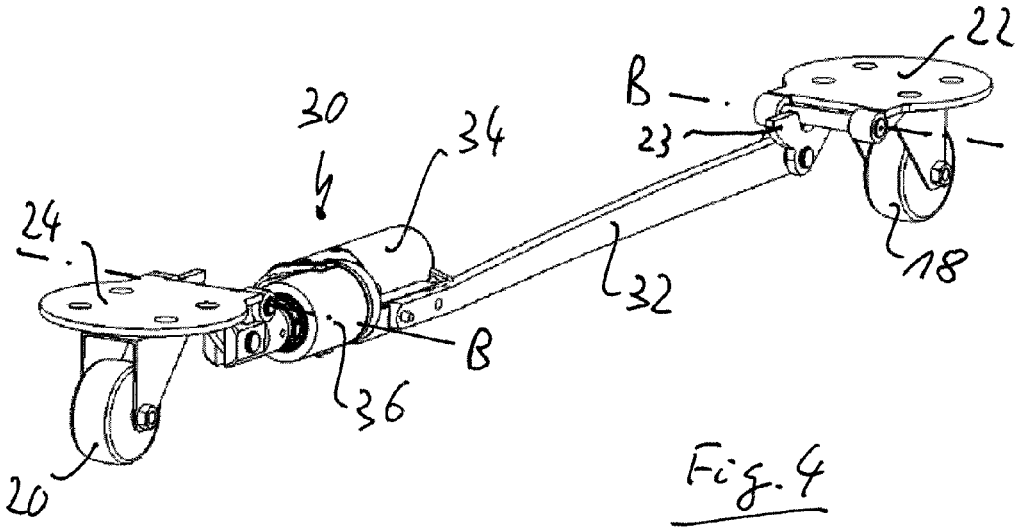
FIG. 4 is a perspective view of two casters which are pivotably connected to one another via a linkage and a drive.

As FIG. 4 illustrates, the linkage 32 is pivotally connected to the one hinge plate 22 and the linkage 32 is connected at its other end to the drive 30 which is in turn connected in an articulated manner at its oppositely disposed end to the hinge plate 24. The drive 30 includes a single electric motor 34 which is coupled to a spindle drive 36 which includes a self-locking transmission. The drive 30 effects a linear movement in the direction of the connection between the two pivot points to the hinge plates 22 and 24, with these pivot points having pivot axes which extend parallel to the horizontal pivot axes B. Since only the two hinge plates 22 and 22 of the arrangement shown in FIG. 4 are connected to the base in an articulated manner in the region of their pivot axes B, both the drive and the linkage can be moved decoupled from the base 10 and both the drive 30 and the linkage 32 are freely movable relative to the base 10 in the direction of movement of the drive.

The base 10 furthermore has a total of four defined supports, with two respective supports being arranged a respective end of a base arm. FIG. 3 shows two supports 40 and 42 which are fastened to the lower side of the base arm 14 and are made in plate shape. In this respect, each support is connected via an associated load cell 44 (cf. FIG. 2) to the base 10 or to the base arm so that the contact force present at the respective support can be measured, for which purpose evaluation electronics are provided which are not shown in any more detail.

An operating table can be positioned on a floor as follows using the apparatus described above.

First, the operating table is rolled to a desired location, with all the casters 18 and 20 being in the moving position which is shown in FIG. 3A and in which the casters are pivoted fully downwardly so that the base does not touch the floor B. Subsequently, the drive 30 can be actuated, whereby the two hinge plates 22 and 24 are pivoted in opposite directions about their horizontal axes B so that the base 10 and thus also the operating table lowers so much until the supports 40, 42 of the base 10 lie completely on the floor B. The driver 30 can in this respect be actuated for so long until the casters 18 and 20 rise from the floor B.

In order to allow a wobble-free installation of the operating table with a not completely level surface B, the drive 30 of a caster pair (or also both drives of the two caster pairs) can subsequently be actuated for so long until the operating table lies on all four supports 40, 42 with the same force. For this purpose, the measured values of the load cells 44 can be compared with one another in the electronic control and the drive 30 can be stopped when all four load cells output a substantially coinciding measured value.

Since both the drive 30 and the linkage 32 are movable between the pivot axes B of the two hinge plates 22 and 24 decoupled from the base 10, a free and independent movement of that caster is possible which does not have any contact, or only insufficient contact, with the floor.

Figure 2:
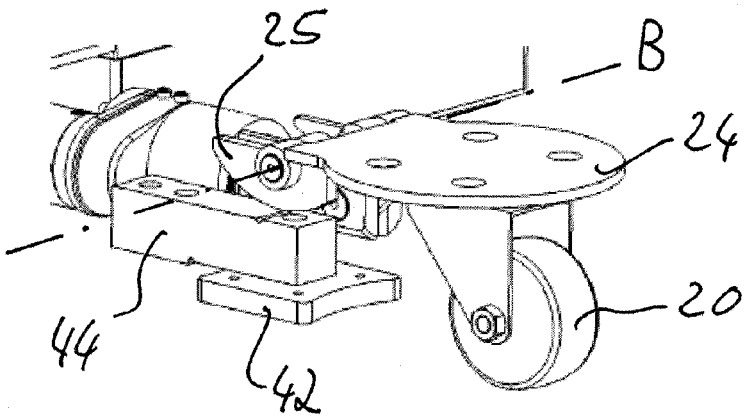
FIG. 2 is a perspective and enlarged view of a part of the base.

As in particular FIG. 2 and FIG. 4 illustrate, each hinge plate 2, 24 is provided with an abutment 23, 25 which abuts a component of the base 10 with a completely pivoted hinge plate (cf. FIG. 3A) so that the same moving position can be set for all casters. When the power consumption of the electric motor 34 of the drive 30 is detected, a simple end deactivation can be realized which is triggered when the motor current has reached a predetermined threshold value.

What is claimed is:

1. An operating table, the operating table comprising:

a movable base; and four casters, each of the casters having a pivot lever, wherein each of the four casters is pivotable about a horizontal axis via the corresponding pivot lever fastened to the movable base from a driving position into a standing position, and wherein:

the pivot levers of a first caster pair of the four casters are connected to one another by a common drive and a linkage, and the drive and the linkage are movable between the pivot axes of the two pivot levers independent of the base.

2. The operating table of claim 1, wherein the drive includes a motor.

3. The operating table of claim 1, wherein the drive causes a linear movement, and the drive and the linkage are freely movable relative to the base in the direction of movement of the drive.

4. The operating table of claim 1, wherein the pivot lever includes a pivot plate that is pivotally connected to the base and to which a caster is fastened.

5. The operating table of claim 1, wherein the pivot levers of a second caster pair of the four casters are also connected to one another via a common drive and a linkage, and wherein the drive and the linkage are movable between the pivot axes of the two pivot levers independent of the base.

6. The operating table of claim 1, wherein all of the casters are swivel casters.

7. The operating table of claim 1, further comprising a measuring device that determines the contact pressure between the casters of the caster pair and the floor.

8. The operating table of claim 2, further comprising a measuring device that:

determines the contact pressure between the casters of the caster pair and the floor, and detects the power consumption of the motor.

9. The operating table of claim 1, wherein the base has four defined supports and a measuring device that determines the support force provided at all supports.

10. An operating table, the operating table comprising:

a movable base;

first, second, third and fourth casters provided at the base, the casters forming a first and second caster pair;

first, second, third and fourth pivot levers each mounted on the base for pivoting movement about a respective pivot axis, and wherein:

each caster is pivotable about a horizontal axis via a respective pivot lever from a driving position in which the base is movable relative to the floor into a standing position in which the base is supported in a stationary position on the floor, the pivot levers a first caster pair of the four casters are connected to one another by a common drive and a linkage, and the drive and the linkage are movable between the pivot axes of the pivot levers associated with the caster pair and are independent of the base.

11. A method for positioning an operating table on a floor, the operating table having a movable base which is provided with four casters which are each pivotable about a horizontal axis via a pivot lever fastened to the base from a driving position into a standing position, wherein the pivot levers of a first caster pair of the four casters are connected to one another by a common drive and a linkage, wherein the drive and the linkage are movable between the pivot axes (B) of the two pivot levers independent of the base and wherein the base has four defined supports and a measuring device for determining the support force provided at all supports, the method comprising pivoting the casters of the base at a desired location of the operating table from their moving position into an end position in which the base is completely lowered onto the floor, with the drive subsequently being actuated for so long until all four measuring devices output a substantially coinciding measured value.

12. The operating table of claim 2, wherein the motor is a single electric motor.

13. The operating table of claim 2, further comprising a self-locking transmission.

* * * * *

UNITED STATES PATENT AND TRADEMARK OFFICE

CERTIFICATE OF CORRECTION

PATENT NO. : 8,657,243 B2
APPLICATION NO. : 13/294982
DATED : February 25, 2014
INVENTOR(S) : Silvio Marugg It is certified that error appears in the above-identified patent and that said Letters Patent is hereby corrected as shown below:

On The Title Page, Column 1, please insert --Assignee: Berchtold Holding GmbH, GERMANY--

Signed and Sealed this
Twentieth Day of October, 2015

Michelle K. Lee

Michelle K. Lee
*Director of the United States Patent and Trademark Office*